US010113267B2

(12) United States Patent
Riggs et al.

(10) Patent No.: US 10,113,267 B2
(45) Date of Patent: Oct. 30, 2018

(54) TENSIONING APPARATUS FOR SYNTHETIC SLING MANUFACTURING APPARATUS AND METHOD

(71) Applicant: SlingMax, Inc., Aston, PA (US)

(72) Inventors: Michael Riggs, Aston, PA (US); Gregory D'Elia, Aston, PA (US); Scott St. Germain, Aston, PA (US)

(73) Assignee: SlingMax, Inc., Aston, PA (US)

( * ) Notice: Subject to any disclaimer, the term of this patent is extended or adjusted under 35 U.S.C. 154(b) by 391 days.

(21) Appl. No.: 15/060,704

(22) Filed: Mar. 4, 2016

(65) Prior Publication Data

US 2017/0254002 A1 Sep. 7, 2017

(51) Int. Cl.
*D07B 7/16* (2006.01)

(52) U.S. Cl.
CPC ..... *D07B 7/165* (2013.01)

(58) Field of Classification Search
CPC ..... D07B 7/165
See application file for complete search history.

(56) References Cited

U.S. PATENT DOCUMENTS 3,758,098 A * 9/1973 Vrilakas ..... B25B 11/00 269/55
4,545,247 A * 10/1985 Wilson ..... G01M 1/04 73/466
4,685,333 A * 8/1987 Wilson ..... G01M 1/04 269/57
4,724,668 A 2/1988 Wassenhoven
4,817,373 A * 4/1989 Gualchierani ..... D01H 9/005 57/281
4,843,807 A 7/1989 von Danwitz
6,256,872 B1 * 7/2001 Landtroop ..... B21F 7/00 242/447.3
6,425,745 B1 * 7/2002 Lavin ..... C23C 4/12 118/321
7,568,333 B2 8/2009 St Germain
2006/0272459 A1 * 12/2006 English ..... B23B 23/00 82/148
2009/0107573 A1 * 4/2009 St Germain ..... D07B 7/14 139/11

* cited by examiner

*Primary Examiner* — Shaun R Hurley
(74) *Attorney, Agent, or Firm* — Panitch Schwarze Belisario & Nadel LLP

(57) ABSTRACT

A sling manufacturing apparatus for constructing a synthetic sling having a cover and a core, includes a frame defining a longitudinal frame axis, a yarn feeder assembly associated with the frame, a drive roller connected to the frame, a tailstock movably mounted to the frame, an idler roller movably mounted to the tailstock, and an idler actuator secured to the tailstock. The drive roller is drivable to draw yarn from the yarn feeder assembly and the tailstock is movable relative to the frame substantially parallel to the longitudinal frame axis. The idler roller is movable relative to the tailstock parallel to the longitudinal frame axis. The idler actuator is configured to move the idler roller from a loading position spaced a first distance from the tailstock to a tensioned position spaced a second distance from the tailstock, wherein the first distance is greater than the second distance.

12 Claims, 7 Drawing Sheets

TENSIONING APPARATUS FOR SYNTHETIC SLING MANUFACTURING APPARATUS AND METHOD

BACKGROUND OF THE INVENTION

The term "rigging" (sometimes referred to as industrial rigging or field rigging) is the branch of securing heavy loads in order to prepare the load to be lifted, moved or transported. Rigging usually refers to the ropes, wires, slings, and chains used to secure the load.

Wire rope slings made of a plurality of metal strands twisted together and secured by large metal sleeves or collars are known in the industry. Since wire rope slings are made of metal, they typically do not require external protection that may be afforded by a covering material. During the recent past, industrial metal slings have seen improvements in flexibility and strength. Metal slings are, however, relatively stiff, inflexible, heavy and subject to fatigue and corrosion when compared to non-metal or synthetic fiber slings.

Synthetic fiber slings have gained popularity in recent years and are replacing metal slings in many circumstances. Thousands of synthetic slings are used on a daily basis in a broad variety of heavy load lifting applications, ranging from ordinary construction (e.g., nuclear power plants, skyscrapers and bridges), plant and equipment operations, ship building (e.g., oil rigs), and the like.

An advantage of synthetic slings over metal slings is that they have a high load-lifting performance strength-to-weight ratio, providing for lighter, more flexible and stronger slings when compared to their heavier, stiff and bulkier metal counterparts. Synthetic slings may also be designed to have resistance to fatigue and corrosion based on the expected working environment of the sling through selection of particular materials for the synthetic sling. Another feature of synthetic slings is the encasement of the load bearing strands of the sling in a protective cover that protects the load-bearing strands from the working environment. The protective cover or sheath requires particular steps in the manufacturing process, primarily encasing the core strands or load-bearing strands inside the protective cover.

Synthetic slings are usually comprised of a lifting core made of twisted strands of synthetic fiber and an outer cover that protects the core. The most popular design of synthetic slings is a roundsling in which the lifting core forms a continuous loop and the sling is generally ring-shaped in appearance. The lifting core fibers of such roundslings may be derived from natural materials (e.g., cotton, linen, hemp, etc.), but are preferably constructed of synthetic materials, such as polyester, polyethylene, nylon, polypropylene, aramids, and the like. The outer covers of synthetic slings are also preferably constructed of synthetic materials and are designed to protect the core fibers from abrasion, cutting by sharp edges, or degradation from exposure to heat, cold, ultraviolet rays, corrosive chemicals, caustic gasses, or other environmental pollutants.

A method of manufacturing prior art roundslings is to twist a plurality of yarns together to form a single strand and the strand is rolled into an endless parallel loop that forms the core. In a separate step, the cover is manufactured as a flat piece and the lifting core is laid on the flat cover material. The flat cover material is subsequently bent around the endless core and the two longitudinally extending edges of the cover are sewn together, thereby encasing the core or lifting fibers. This method of manufacturing roundslings is time consuming and labor intensive, thus increasing the costs to manufacture the sling. Another prior art method involves mechanical wrapping of the core strands into a protective cover cut at one location along its length and subsequent closing of the cover at the cut. This prior art method is generally described in U.S. Pat. No. 7,568,333, which is incorporated herein by reference in its entirety.

The core strands, lifting fibers or lifting cores are tensioned during the manufacturing process to produce a sling wherein each of the core strands is generally, equally preloaded during production. It is preferred that each sling produced or constructed on a sling manufacturing machine has the same tension to produce consistent slings. Prior art sling tensioning has been substantially manually monitored and applied through the skill and experience of the operator.

These prior art methods of manufacturing roundslings are generally labor intensive, require physical exertion of the operator during various portions of the process and may result in inconsistency of tensioning from machine to machine and operator to operator. One of the labor intensive processes includes readjusting an idler roller of the system to ensure appropriate tension in the roundsling is maintained during the process. It is desirable to develop a system and method for reducing the physically intensive process of adjusting the idler roller and accurately maintaining desired tension in the roundsling during production.

BRIEF SUMMARY OF THE INVENTION

Briefly stated, in a preferred embodiment, the present invention is directed to an apparatus for constructing a synthetic sling having a cover and a core constructed of yarns or fibers. The apparatus includes a frame defining a longitudinal frame axis and a yarn feeder assembly associated with the frame. The apparatus also includes a drive roller connected to the frame, a tailstock movably mounted to the frame, an idler roller movably mounted to the tailstock and an idler actuator secured to the tailstock and the idler roller. The drive roller is drivable to draw yarn from the yarn feeder and the tailstock is movable relative to the frame at least substantially parallel to the longitudinal frame axis. The idler roller is movable relative to the tailstock substantially parallel to the longitudinal frame axis and the idler actuator is configured to move the idler roller from a loading position spaced at a first distance from the tailstock to a tensioned position spaced at a second distance from the tailstock, wherein the first distance is greater than the second distance.

The preferred apparatus of the present invention includes a hydraulic tailstock that was developed to increase efficiency and consistency of the production of synthetic roundslings. The hydraulic tailstock allows the fabricator to locate the tailstock in a specific location, as required for a given finished sling length, by "locking" the hydraulic section to the rails of the sling manufacturing apparatus. Once the hydraulic tailstock is locked into place, the fabricator can fabricate multiple slings of this given length repetitively without having to relocate the entire tailstock to the proper location each time a sling is completed and removed from the machine. The hydraulic tailstock also allows the fabricator to monitor and reduce tension in the sling(s) being fabricated, as needed, as tension typically increases as core yarn is added due to the thickness of the core yarns. Tension is preferably monitored by periodically checking the pressure in the hydraulic system via the pressure gauge mounted on the hydraulic tailstock. A pointer and scale help the fabricator keep track of how much the tailstock has moved during the fabrication process, if at all, so that sling length remains consistent.

Completed slings are easily removed from the sling manufacturing apparatus by relieving the hydraulic pressure on the idler roller and extending the hydraulic cylinders. As the cylinders extend, the tailstock moves toward the machine's drive end making it possible to remove the completed sling(s). Once the completed sling(s) is removed, the tailstock is returned to the starting, fully retracted position to begin fabrication of the next sling(s) of the same set length.

The hydraulic tailstock also aids in applying a pre-failure warning indicator to the completed sling. When applying a preferred pre-failure warning indicator to the sling, tension is released to verify core yarn count and then reapplied to tie a warning indicator fiber to the core yarns. The pre-failure warning indicator may be configured and applied in the same or a similar manner to the pre-failure warning indicator described in U.S. Pat. No. 7,661,737, titled, "Sling with Predictable Pre-Failure Warning Indicator of St. Germain, the contents of which are incorporated herein by reference in their entirety.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there is shown in the drawings an embodiment which is presently preferred. It should be understood, however, that the invention is not limited to the precise arrangements and instrumentalities shown. In the drawings.

DETAILED DESCRIPTION OF THE INVENTION

Figure 1:
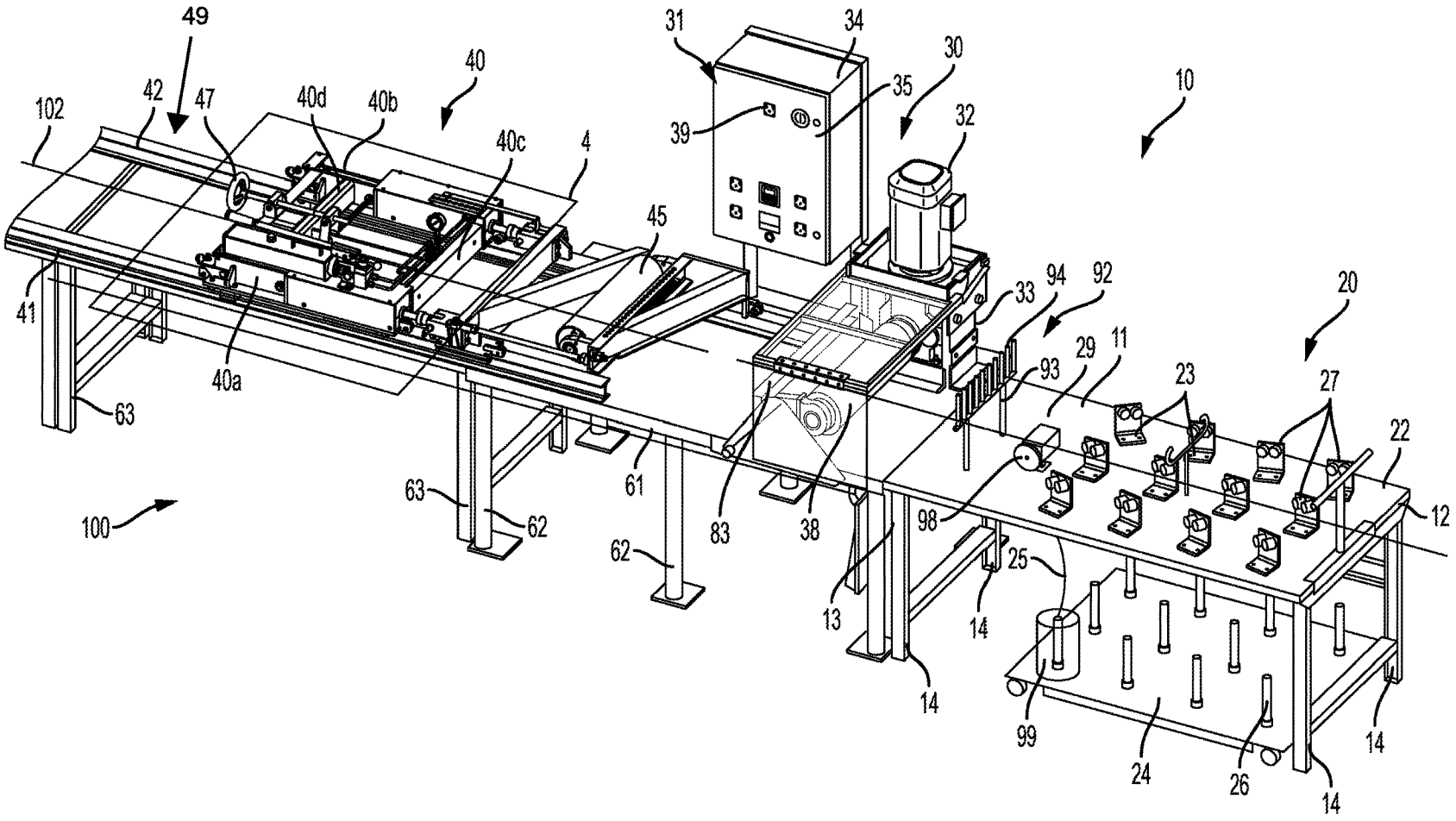
FIG. 1 is a top perspective view of a synthetic sling manufacturing apparatus in accordance with a preferred embodiment of the present invention.

Certain terminology is used in the following description for convenience only and is not limiting. Unless specifically set forth herein, the terms "a", "an" and "the" are not limited to one element but instead should be read as meaning "at least one". The words "right," "left," "lower," and "upper" designate directions in the drawings to which reference is made. The words "inwardly" or "distally" and "outwardly" or "proximally" refer to directions toward and away from, respectively, the geometric center or orientation of the device and instruments and related parts thereof. The terminology includes the above-listed words, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally the same or similar, as would be understood by one having ordinary skill in the art. At a minimum, such references that include a numerical parameter would include variations that, using mathematical and industrial principles accepted in the art (e.g., rounding, measurement or other systematic errors, manufacturing tolerances, etc.), would not vary the least significant digit.

Figure 2:
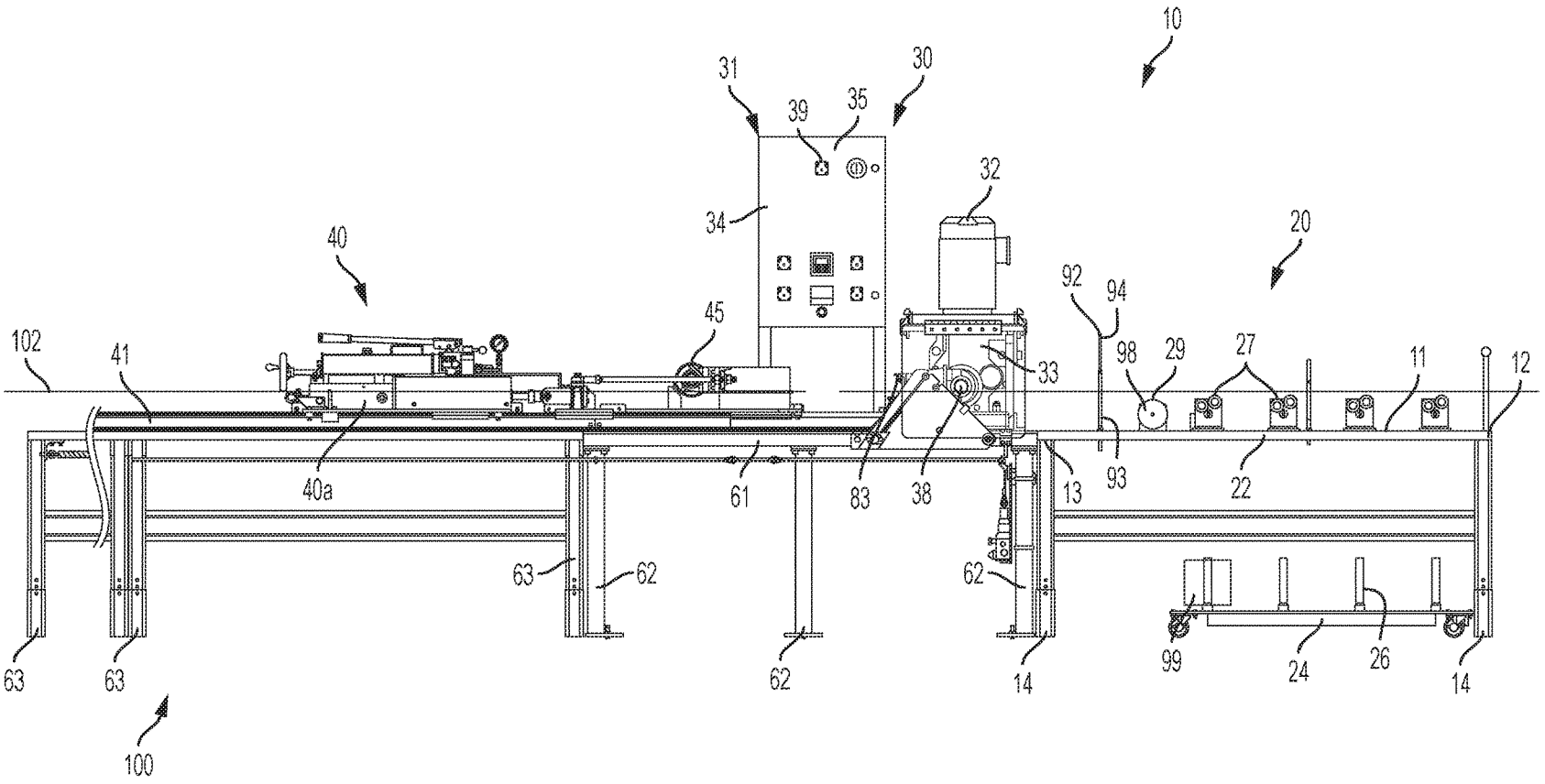
FIG. 2 is a side elevational view of the synthetic sling manufacturing apparatus of FIG. 1.
Figure 3:
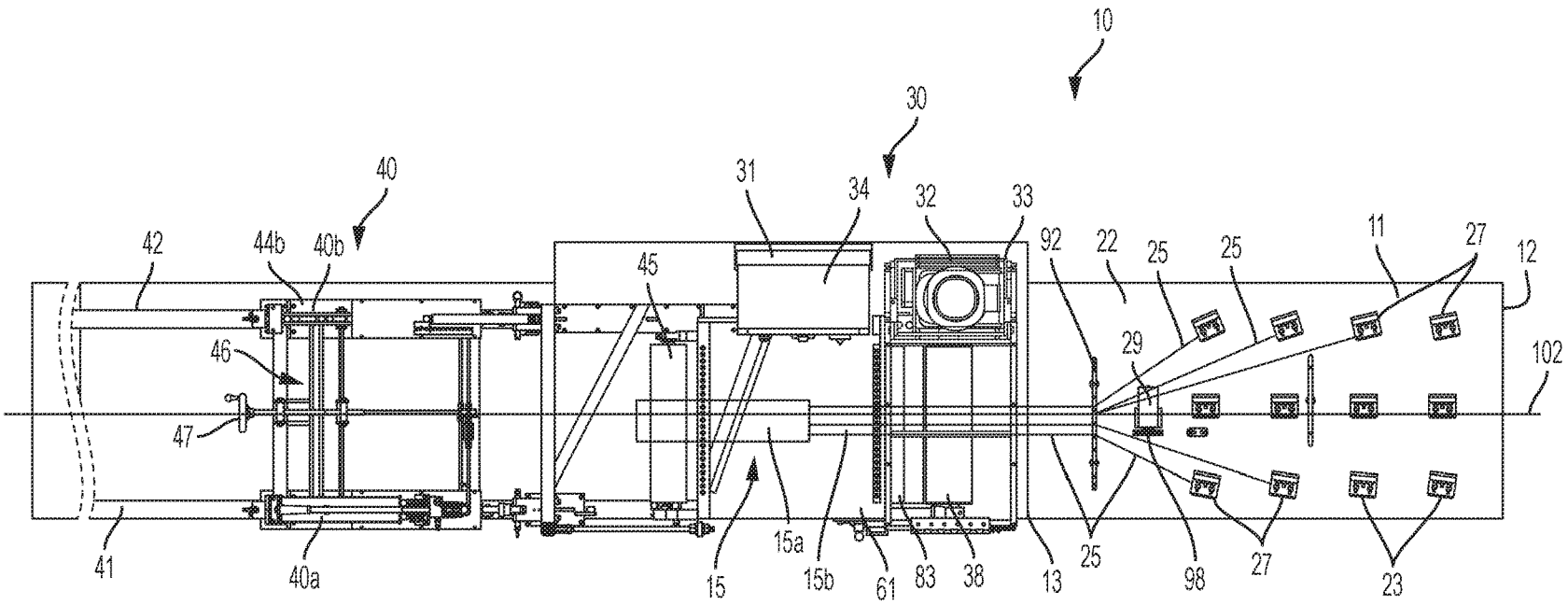
FIG. 3 is a top plan view of the synthetic sling manufacturing apparatus of FIG. 1.

Referring to FIGS. 1-3, a preferred embodiment of the present invention is directed to a synthetic sling manufacturing apparatus, generally designated 10, for manufacturing or producing synthetic slings 15. The slings 15 preferably have a cover 15*a* and a core 15*b*. The cover 15*a* is preferably constructed of a woven synthetic material that generally protects the core 15*b* during use and the core 15*b* is preferably constructed of a synthetic or polymeric material. The cover 15*a* is not limited to being constructed of a woven synthetic material and may be constructed of nearly any material with any construction that is able to take on the general size and shape of the cover 15*a*, withstand the normal operating conditions of the cover 15*a* and perform the preferred functions of the cover 15*a*. The core 15*b* is preferably constructed of one or more yarns of natural or synthetic materials, such as polyester, polyethylene, nylon, K-Spec® (SlingMax®, Inc. material comprising a proprietary blend of fibers), high-modulus polyethylene (HMPE), liquid crystal polymer (LCP), aramid, para-aramid, or other synthetic material. The type and quantity of material of the core 15*b* may relate to the maximum weight that the sling 15 is designed to lift, the environment in which the sling 10 is deployed or other factors relevant to the design of the sling 15 and its environment. In general, material of the core 15*b* preferably has a high lifting and break strength, relatively light weight, high temperature resistance and high durability, compared to wire rope or metal chain slings.

The synthetic sling manufacturing apparatus 10 preferably includes a yarn feeder assembly 20, a control assembly 30, a tailstock 40 and a frame 100. The frame 100 preferably supports or includes portions of the yarn feeder assembly 20, the control assembly 30 and the tailstock 40. The frame 100 provides structural support for the various components of the sling manufacturing apparatus 10.

The frame 100 includes a yarn feeder table 22 having a flat table top 11 with a first end 12 and a second end 13 that supports the yarn feeder assembly 20. The second end 13 is preferably abutted against and attached to the control assembly 30, but is not so limited. The feeder table 22 and the support of the control assembly 30 may be integrally formed together and are both preferably part of the frame 100. As illustrated in FIGS. 1-3, the yarn feeder table 22 preferably has one or more legs 14 to support the table top 11, but is not so limited and may be otherwise constructed without legs 14, as long as the feeder table 22 is able to withstand the normal operating conditions of the yarn feeder assembly 20 and perform the typical functions of the yarn feeder assembly 20, as are described in greater detail below.

The preferred yarn feeder table 22 has a plurality of openings 23 spaced at intervals in the table top 11 for allowing individual strands 25 of yarn to pass therethrough. The individual strands 25 of yarn from spools 99 are preferably twisted together, as will be described herein, to construct the load-bearing inner core 15*b* of the sling 15. In the exemplary preferred embodiment, the apparatus 10 has twelve (12) yarns that may be utilized to form strands of the inner core 15*b*. The preferred yarn feeder table 22, therefore, has twelve (12) openings 23, but is not so limited and may have nearly any number of openings 23 to accommodate nearly any number of strands 25 to form the core 15*b*. If the preferred apparatus or machine 10 is set up to manufacture a multiple-path (e.g., a Twin-Path® brand dual-core sling 15 or a sling 15 having more than two inner cores 15*b*), the yarns are preferably twisted together to make each core 15*b* of the multiple-path sling 15.

The individual yarns that are assembled into the inner core 15*b* are preferably delivered from the spools or rolls 99 positioned beneath the table top 11, but are not so limited and may be stored and delivered in nearly any manner that accommodates assembling the yarns into the inner core 15*b*.

A spool table 24 is preferably positioned below the table top 11 for holding the spools 99, such as the twelve (12) spools 99 of the preferred yarn feeder assembly 20. In the preferred embodiment, not every sling 15 requires use the maximum number of yarns or employing each of the spools 99 during use. For example, slings 15 designed and rated for lifting of loads that do not require each of the twelve (12) yarns and some slings 15 may only employ a select number of the spools 99, for example, a single path sling 15 may be constructed utilizing a single length of yarn from a single spool 99 to construct the inner core 15*b*.

The spool table 24 preferably includes a plurality of elongated extensions 26 (preferably rod-shaped) that extend from the top surface of the spool table 24 toward the underside of the yarn table 22 that correspond to the number of spools 99 and openings 23 of the preferred machine 10. The spools 99 are preferably positioned over each of the extensions 26 on the spool table 24 and the spool's 99 weight and the elongated extensions 26 keep the spools 99 on the spool table 24, but is not so limited and each of the extensions 26 does not necessarily include a spool 99 associated therewith when not all yarns are required to construct the sling 15.

In the preferred embodiment, each yarn opening 23 is associated with a spring-tensioning device 27, respectively. The spring-tensioning devices 27 preferably apply tension or resistance to the associated strand 25 to limit slack in the strand 25 during manufacturing. The spring-tensioning devices 27 are preferably adjustable to increase or decrease the amount of tension applied to the respective strand 25.

The sling manufacturing apparatus 10 of the preferred embodiment includes an encoder 29. The preferred encoder 29 includes an encoder wheel 98 and its related circuitry that counts the number of revolutions of the encoder wheel 98. In use, the strands 25 move over the encoder wheel 98 and a counter circuit that is connected to the wheel 98 that measures a length of the strands 25 drawn from the spools 99. The encoder 29 permits measurement of the length of the strands 25, which may be stored by the control assembly 30 to compare consistency of manufactured slings 15 and for other related purposes.

A comb or fiber guide 92 is preferably positioned proximate the second end 13 of the yarn table 11 at a junction between the yarn table assembly 20 and the control assembly 30. The fiber guide 92 preferably ensures that the strands 25 do not prematurely begin twisting and/or become tangled and guides the strands 25 into a preferred configuration for construction into the core 15*b*. For example, the comb or fiber guide 92 may separate the strands 25 into paths for the core 15*b* in a single, double or other multiple core sling 15. The fiber guide 92 preferably includes a base section 93 and a plurality of elongated projections 94, which may be referred to as teeth or tines. The elongated projections 94 are preferably rod-shaped, are removable and can be re-inserted into different holding recesses to adjust the separation between each individual strands 25 with respect to adjacent strands 25. Each projection 94 is preferably insertable into a desired receptacle and secured, preferably by a friction fit, but is not so limited and may be bolted, bonded, clamped or otherwise secured to the base section 93.

The fiber guide 92 preferably keeps the strands 25 separated until they are directed into the cover 15*a* to ensure a tight twisting of the strands 25 as they form the load-bearing core 15*b* of the sling 25. In one preferred embodiment, the elongated projections 94 are shaped like rods and are frictionally-fitted into the base 93. In another preferred embodiment, one end of each projection 94 can be manufactured with threads for engagement with the base 93. By moving the projection 94 into the base 93, the separation of the strands 25 can be controlled and managed, and ultimately the "tightness" of the wrap of strands 25 that form the load-bearing core 15*b* can be controlled.

The control assembly 30 preferably includes a control box 34 housing control circuitry and a control panel 31. A counter circuit for the encoder 29 is preferably stored in the control box 34 and the control box 34 is also preferably able to store data acquired from the encoder 29. A display 35 is preferably, electrically connected to the counter circuit and is mounted on the control panel 31 for conveying to the machine's operator the length of yarn or strands 25 pulled from the spools 99 and used to manufacture the load-bearing core 15*b*.

The control assembly 30 also includes preferably includes an electric motor 32 that provides motive force for driving the construction of the core 15*b* of the sling 15 on the sling manufacturing apparatus 10. The electric motor 32 preferably turns a drive roller 38 and is preferably connected by a chain (using sprockets), belt, a worm gear reducer or gearbox 33 or other mechanisms that convert the driving motion of the motor 32 into rotational motion of the drive roller 38 to draw the strands 25 over the drive roller 38 when forming the core 15*b*. An on/off switch 39 preferably controls power to the sling manufacturing apparatus 10 and, more specifically to the control circuit.

The encoder 29 along with the encoder wheel 98 are preferably mounted on the yarn table 11, but may be placed anywhere on the frame 100 so that at least one strand 25 engages the wheel 98 to turn the wheel 98, thereby allowing the encoder circuit to determine the length of strands 25 used to manufacture the load-bearing core 15*b*. The encoder display 35 preferably conveys to the operator a length of strands 25 used to construct the core 15*b*, preferably in feet or yards, but is not so limited.

The control assembly 30 is preferably mounted on a table 61 supported by one or more legs 62, which form a portion of the frame 100. The tailstock 40 is preferably mounted on an open frame 49 so that the working area of the feeder assembly 20, control assembly 30 and tailstock 40 are all relatively in the same working plane. The tailstock 40 is not limited to being mounted on an open frame 49 and may be mounted on a table or on a separate structure that forms a portion of the frame 100. In addition, the working areas of the feeder assembly 20, the control assembly 30 and the tailstock 40 are not limited to being positioned in the same working plane and may be positioned on and in multiple planes, as long as the components are configured in an orientation to form the preferred slings 15. One or more legs 63 of the preferred frame 100 support the open frame 49 of the tailstock 40. The sling manufacturing apparatus 10 is preferably designed for modularity to allow for easy assembly and disassembly, but is not so limited and may be integrally formed, custom constructed or otherwise configured depending on designer and user preferences.

Referring to FIGS. 1-5, the tailstock 40 is preferably, movably securable to the frame 100 and spaced from the feeder assembly 20. The tailstock 40 and feeder assembly 20 are preferably arranged or secured relative to each other by the frame 100, such that the frame 100 defines a longitudinal frame axis 102. The longitudinal frame axis 102 of the preferred embodiment extends substantially parallel to the strands 25 and the core 15*b* of the sling 15. The frame 100 of the preferred sling manufacturing apparatus 10 includes a pair of rails 41, 42 on which the tailstock 40 is movably mounted. An idler roller 45 is movably mounted to the tailstock 40 and is, therefore, movable with the tailstock 40, preferably along or parallel to the longitudinal axis 102. The rails 41, 42 preferably ensure that the tailstock 40 and, in particular, the idler roller 45 is parallel to the drive roller 38 during use such that the yarns in the core 15*b* have substantially the same length upon completion of the sling 15. This also preferably ensures that the strands or yarns 25 that form the load-bearing core 15*b* are properly twisted and slide with the least amount of friction into and within the cover 15*a* of the sling 15.

Figure 4:
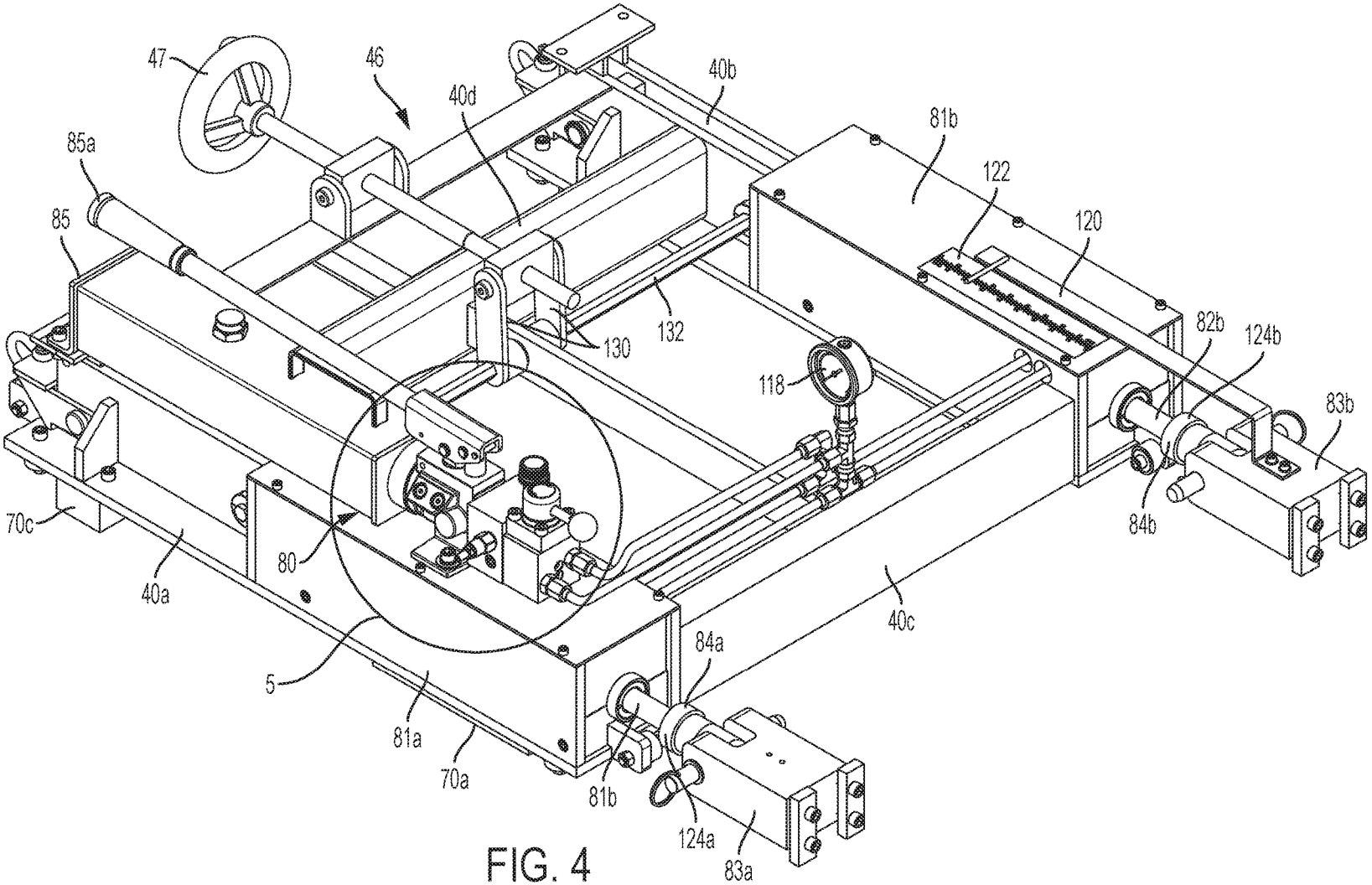
FIG. 4 is a top perspective view of a hydraulic tailstock of the synthetic sling manufacturing apparatus of FIG. 1, taken from within box 4 of FIG. 1.
Figure 5:
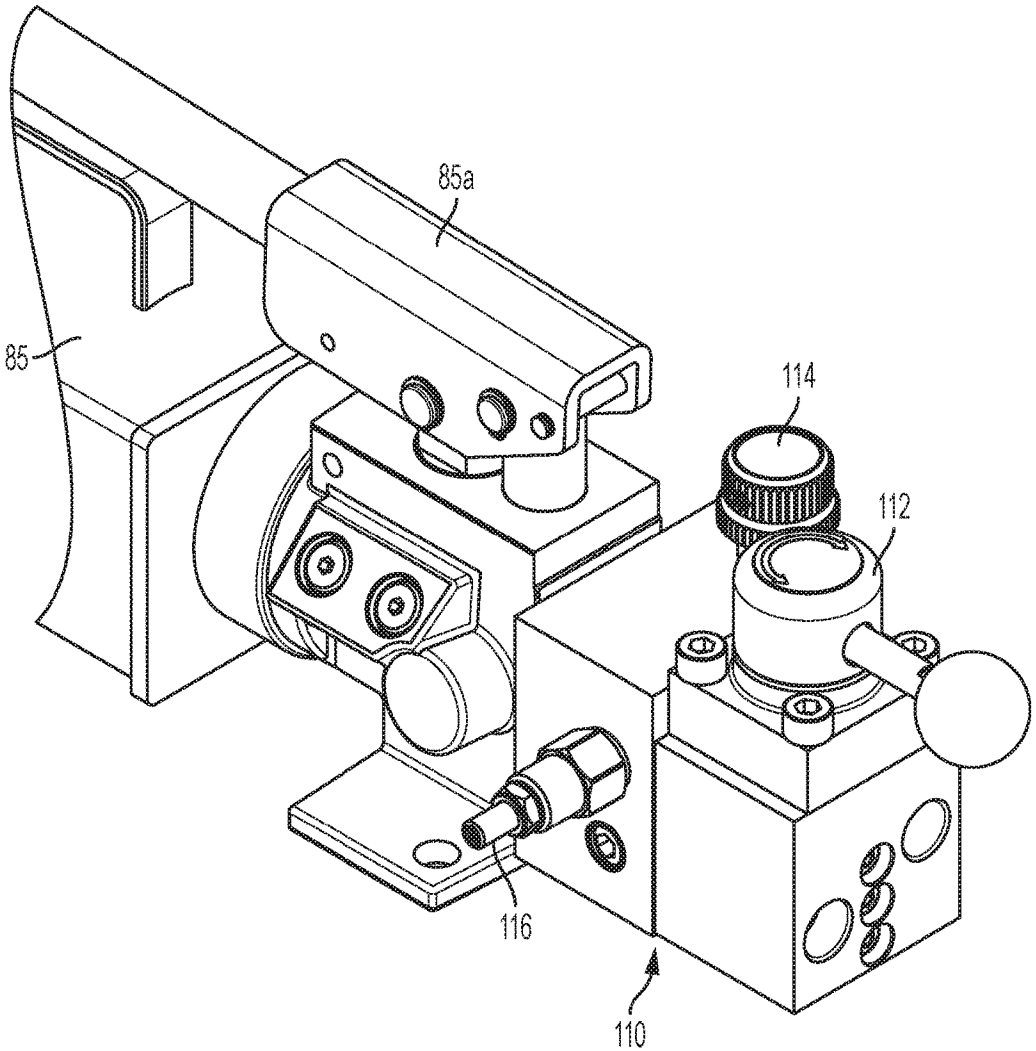
FIG. 5 is a magnified top perspective view of a pump and hydraulic sandwich of the synthetic sling manufacturing apparatus of FIG. 1, taken from within circle 5 of FIG. 4.
Figure 6:
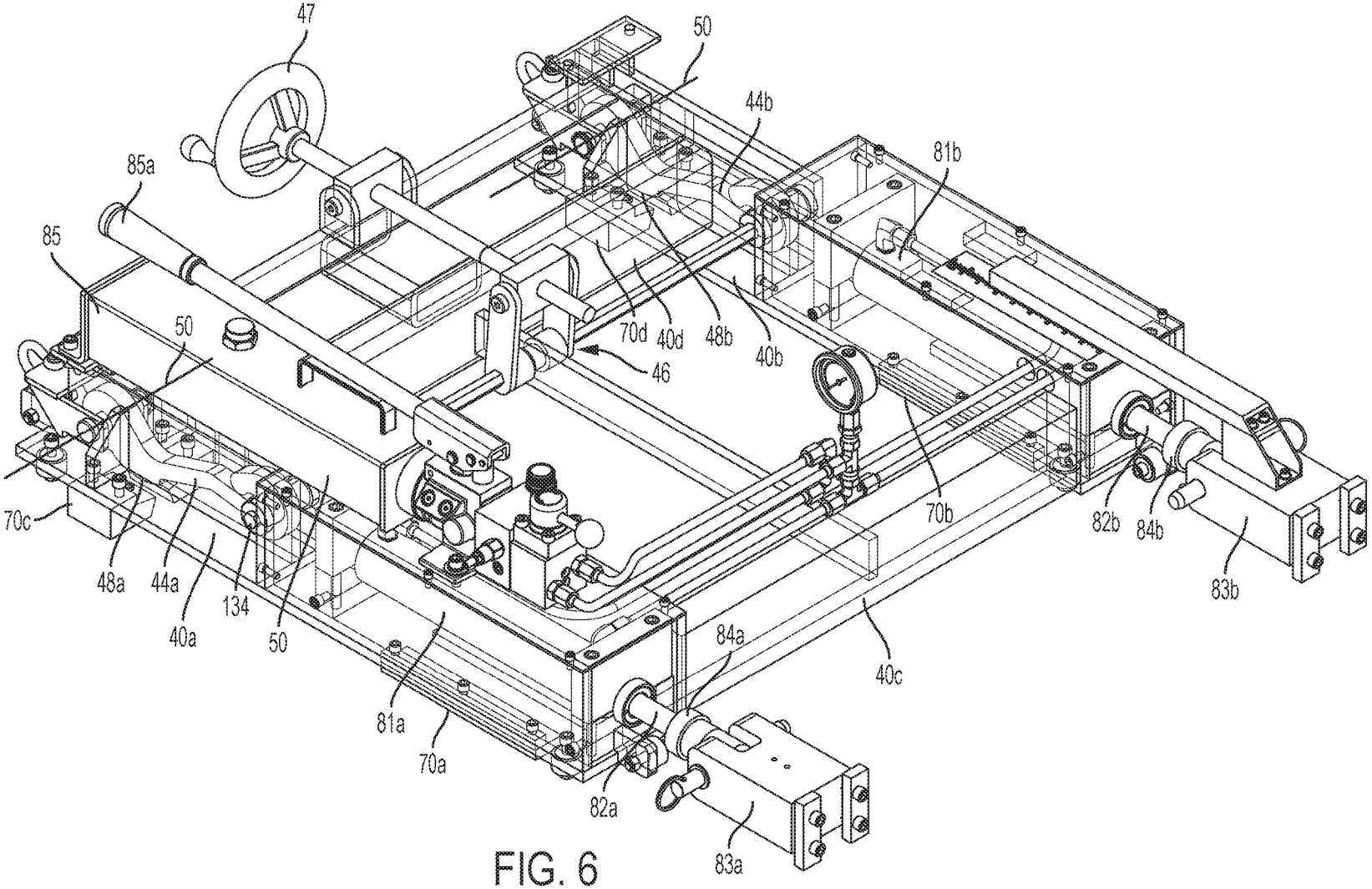
FIG. 6 is a top perspective view of the hydraulic tailstock of the synthetic sling manufacturing apparatus of FIG. 1, wherein certain components are shown as partially transparent to clarify embedded components within the assembly.
Figure 7:
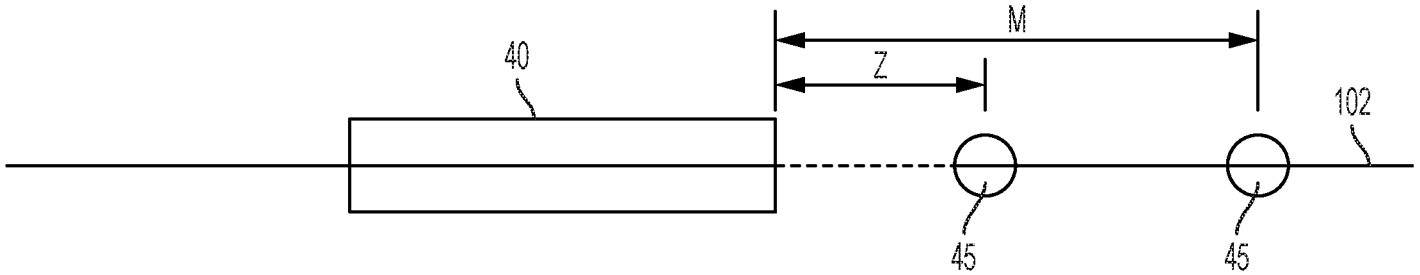
FIG. 7 is a side elevational, schematic view of a tailstock and idler roller of the synthetic sling manufacturing apparatus of FIG. 1.
Figure 8:
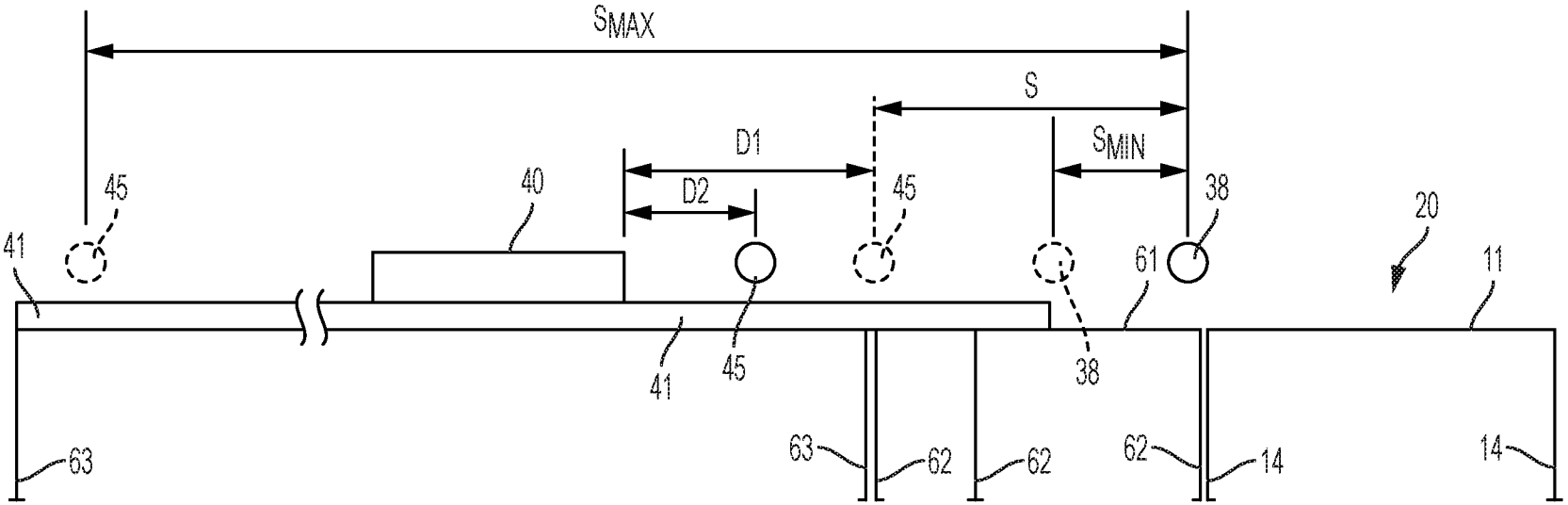
FIG. 8 is a side elevational, schematic view of the tailstock, idler roller, drive roller and other components of the synthetic sling manufacturing apparatus of FIG. 1.

Referring to FIGS. 4-6, the tail stock 40 is movably mounted to the frame 100, such that the tailstock 40 is able to move relative to the frame 100 at least substantially parallel to the longitudinal frame axis 102. The preferred tailstock 40 has a substantially box-type configuration including a first leg 40*a*, a second leg 40*b*, a first cross member 40*c* and a second cross member 40*d*. The first and second legs 40*a*, 40*b* extend substantially parallel to the rails 41, 42, slide above and along the rails 41, 42 and are oriented substantially parallel to the longitudinal axis 102. The cross members 40*c*, 40*d* are attached at their ends to the legs 40*a*, 40*b*, space the first and second legs 40*a*, 40*b* relative to each other over the rails 41, 42, provide structural support and rigidity for the tailstock 40 and are oriented substantially perpendicular to the longitudinal axis 102. The first and second legs 40*a*, 40*b* and the first and second cross members 40*c*, 40*d* are preferably constructed of a relatively rigid metallic material that provides strength, rigidity and structural support to the tailstock 40, such as a structural steel or aluminum material. The legs 40*a*, 40*b* and cross members 40*c*, 40*d* are not limited to metallic constructions and may be constructed of composite, polymeric or other material that is able to take on the general size and shape of the legs 40*a*, 40*b* and cross members 40*c*, 40*d* and withstand the normal operating conditions of the tailstock 40.

The preferred tailstock 40 includes a clamp 44*a*, 44*b* that is movable between a released position and a locked position. The clamp 44*a*, 44*b* is engaged with the frame 100 in the locked position to resist movement of the tailstock 40 relative to the frame 100. As the drive roller 38 pulls the yarn or strands 25 into the cover 15*a* of the roundsling 15 from the feeder assembly 20, a certain amount of tension is created on the idler roller 45. By locking the tailstock 40 and the idler roller 45 into place relative to the frame 100 and the drive roller 38, the load-bearing cores 15*b* of the sling 15 can be manufactured in substantially one continuous step. In the preferred embodiment, the clamp 44—is comprised of first and second clamps 44*a*, 44*b* that are movably attached to the tailstock 40. The first clamp 44*a* is preferably pivotably mounted to the first leg 40*a* and the second clamp 44*b* is preferably pivotably mounted to the second leg 40*b*. The first and second clamps 44*a*, 44*b* are connected to a clamp linkage 46 that is attached to a linkage wheel 47. The clamp linkage 46 and the linkage wheel 47 actuate the first and second clamps 44*a*, 44*b* between the released position and the locked position. The first and second clamps 44*a*, 44*b* are pivotable about a clamp pivot axis 50 and include a stopper surface 48*a*, 48*b*, respectively, that moves relative to the rails 41, 42 to contact the rails 41, 42 in the locked position and is spaced from the rails 41, 42 in the released position. Specifically, in the locked position, the user turns the linkage wheel 47 to actuate the clamp linkage 46 to move the stopper surfaces 48*a*, 48*b* into contact with the rails 41, 42. The engagement between the stopper surfaces 48*a*, 48*b* and the rails 41, 42 preferably locks or limits movement of the tailstock 40 relative to the rails 41, 42. To release the tailstock 40, the user turns the linkage wheel 47 in an opposite direction to actuate the clamp linkage 46, which causes the first and second clamps 44*a*, 44*b* to pivot about the clamp pivot axis 50, thereby causing the stopper surfaces 48*a*, 48*b* to move away from and disengage from the rails 41, 42. When the stopper surfaces 48*a*, 48*b* move away from or are disengaged from the rails 41, 42, the user is able to slide the tailstock 40 along the rails 41, 42, generally parallel to the longitudinal axis 102. The tailstock 40 is not limited to including the first and second clamps 44*a*, 44*b* to selectively secure the tailstock 40 to the frame 100 and may include alternative mechanisms to secure the tailstock 40 to the frame 100, such as pins, fasteners, external clamps, hydraulic locking mechanisms or other fastening mechanisms that are able to hold and lock the tailstock 40 to the frame 100 in the locked configuration.

The preferred tailstock 40 also preferably includes sliding blocks 70 attached to lower portions of the first and second legs 40*a*, 40*b*. In the preferred embodiment, the sliding blocks 70 include first, second, third and fourth sliding blocks 70*a*, 70*b*, 70*c*, 70*d* attached to lower surfaces of the first and second legs 40*a*, 40*b* that slidably engage the rails 41, 42. The a first, second, third and fourth sliding blocks 70*a*, 70*b*, 70*c*, 70*d* are preferably connected to lower corners or corner areas of the first and second legs 40*a*, 40*b* to guide the movement of the tailstock 40 along the rails 41, 42, generally parallel to the longitudinal axis 102 and to secure the tailstock 40 to the rails 41, 42. The sling manufacturing apparatus 10 is not limited to including four (4) sliding blocks 70 and may be comprised of a single sliding block, multiple sliding blocks, wheels, tongue and groove mechanisms or other mechanisms and joints that are able to secure the tailstock 40 to the frame 100 and permit movement of the tailstock 40 relative to the frame 100, preferably parallel to the longitudinal axis 102. In the preferred embodiment, the first and third sliding blocks 70*a*, 70*c* are slidably engaged with the first rail 41 and the second and fourth sliding blocks 70*b*, 70*d* are slidably engaged with the second rail 42. In the locked configuration, the first and second clamps 44*a*, 44*b* preferably urge the sliding blocks 70*a*, 70*b*, 70*c*, 70*d* into engagement with the rails 41, 42 to lock or secure the tailstock 40 to the frame 100.

Referring to FIGS. 1-6, the tailstock 40 also preferably includes an idler roller 45 movably and preferably rotatably mounted, thereto. The idler roller 45 is preferably mounted in a substantially perpendicular orientation relative to the longitudinal axis 102 and the first and second legs 40*a*, 40*b*. The idler roller 45 is not limited to being rotatable relative to the tailstock 40 and may be rotatably fixed to the tailstock 40 without significantly impacting the performance of the idler roller 45. The idler roller 45 is also preferably slidably attached to the pair of rails 41, 42 through the tailstock 40 and is movable, preferably substantially parallel to the longitudinal frame axis 102 relative to the tailstock 40. The idler roller 45 is preferably movable substantially parallel to the longitudinal axis 102, away from or towards the drive roller 38. The idler roller 45 and the drive roller 38 are preferably oriented substantially parallel relative to each other and substantially perpendicular to the longitudinal axis 102 such that the sling 15 can be arranged and constructed thereon, as will be described in greater detail below.

Referring to FIGS. 1-8, a spacing S between the idler roller 45 and the drive roller 38 is approximately equal to the full length of the sling 15 that is being constructed on the sling manufacturing apparatus 10. In other words, if it is desired to construct the roundsling 15 having a ten foot (10') length, the idler roller 45 is preferably positioned ten feet (10') away from the drive roller 38. The drive roller 38 is not limited to being rotatably attached to the frame 100 and the idler roller 45 is not limited to being rotatably mounted to the tailstock 40. The idler roller 45 may be fixed to the frame 100 such that the core 15*a* slides over the idler roller 45 during operation and the drive roller 38 may be attached to the tailstock 40 to draw the strands from the feeder assembly 20 to construct the core 15*b*. The preferred frame 100 has a length to accommodate a range for the spacing S of approximately four feet (4') to approximately sixty feet (60'). The frame 100 and spacing S are not limited to having these enumerated sizes and lengths and the sling manufacturing apparatus 10 may be designed and configured to have longer or shorter sizes, depending on user and designer requirements.

The sling manufacturing apparatus 10 preferably includes an idler actuator 80 secured to the tailstock 40 and the idler roller 45. The idler actuator 80 is configured to move the idler roller 45 from a loading position spaced at a first distance D1 from the tailstock 40 to a tensioned position spaced at a second distance D2 from the tailstock 40. The first distance D1 is greater than the second distance D2. The first and second distances D1, D2 of the idler roller 45 relative to the tailstock 40 are not limited to specific distances, but are relative positions of the idler roller 45 relative to the tailstock 40 driven by actuation of the idler actuator 80. In the tensioned position, the sling 15 being processed by the sling manufacturing apparatus 10 is preferably tensioned at a predetermined tension to ensure substantially equivalent tensions of the strands 25 in the core 15*b* during manufacturing. The second distance D2 may change during manufacturing of a particular sling 15, as slings 15 with numerous core strands 25 that are relatively thick typically are constructed by adjusting the positioning of the idler roller 45 such that a substantially consistent tension is maintained on the core 15*b* during manufacturing.

The idler actuator 80 is comprised of a hydraulic actuator in the preferred embodiment. The idler actuator 80 is not limited to hydraulic actuators and may be comprised of any actuator that is able to move the idler roller 45 relative to the tailstock 40 toward and away from the tailstock 40, preferably substantially parallel to the longitudinal frame axis 102. The idler actuator 80 may alternatively be comprised of pneumatic, electric, magnetic, thermal, mechanical or other varieties of actuators that are able to move the idler roller 45 relative to the tailstock 40, as is described. The preferred idler actuator 80 includes a first cylinder 81*a* with a first shaft 81*b* slidably mounted therein and mounted to the first leg 40*a* and a second cylinder 82*a* with a second shaft 82*b* slidably mounted therein and mounted to the second leg 40*b*. External ends 84*a*, 84*b* of the first and second shafts 81*b*, 82*b* are connected to the idler roller 45 through first and second connection blocks 83*a*, 83*b*, respectively, but are not so limited. The first and second shafts 81*b*, 82*b* may be connected directly to the idler roller 45 or alternative engagement mechanisms, other than the connection blocks 83*a*, 83*b*, may be configured to connect the external ends 84*a*, 84*b* of the first and second shafts 81*b*, 82*b* to the idler roller 45. In addition, the idler actuator 80 is not limited to including the pairs of cylinders 81*a*, 82*a* and shafts 81*b*, 82*b* to move the idler roller 45 and may be configured as a single cylinder and shaft to actuate the movement of the idler roller 45, more than two cylinders and shafts or alternative actuation mechanisms that move the idler roller 45 relative to the tailstock 40.

The idler actuator 80 of the preferred embodiment also includes a pump 85 that is in fluid communication with the first and second cylinders 81*a*, 82*a* to provide pressurized fluid to the cylinders 81*a*, 82*a* to move the shafts 81*b*, 82*b*. The pump 85 is connected to the cylinders 81*a*, 82*a* via a series of hydraulic tubes that carry the fluid or gas to the cylinders 81*a*, 82*a* to pressurize the cylinders 81*a*, 82*a* on opposite sides of a piston (not shown) connected to an end of the shafts 81*b*, 82*b* within the cylinders 81*a*, 82*a*. In the preferred embodiment, the pump 85 is comprised of a hand pump with a handle 85*a* that may be manipulated by an operator to pressurize the fluid or gas in the pump 85. The pump 85 is not limited to being comprised of a hand pump and may be comprised of any variety of pump that is able to provide pressurized fluid or gas to the cylinders 81*a*, 82*a* at an appropriate pressure, withstand the normal operating conditions of the pump 85 and operate with the sling manufacturing apparatus 10. For example, the pump 85 may be comprised of a hydraulic pump driven by a motor associated with the pump 85 or may be driven by the electric motor 32.

Referring to FIGS. 4 and 5, the idler actuator 80 also preferably includes a sandwich 110 in fluid communication with the pump 85 and the hydraulic tubes to regulate the pressure in the cylinders 81*a*, 82*a*. The sandwich 110 preferably includes a directional control valve 112, a needle valve 114 and a relief valve 116. The sandwich 110 is preferably positioned between the pump 85 and the first and second cylinders 81*a*, 82*a*. The directional control valve 112 may be actuated in an "IN" direction to urge pressurized fluid or gas into a front end of the first and second cylinders 81*a*, 82*a* proximate the external ends 84*a*, 84*b* to force the first and second shafts 81*b*, 82*b* into the first and second cylinders 81*a*, 82*a* and move the idler roller 45 toward the tailstock 40 into the tensioned position. The directional control valve 112 may also be actuated in an "OUT" direction to urge pressurized fluid or gas into a rear end of the first and second cylinders 81*a*, 82*a* to move the idler roller 45 away from the tailstock 40 and into the loading position. The hydraulic tubes are configured to substantially equalize the pressures in the associated sides of the first and second cylinders 81*a*, 82*a* such that the idler roller 45 is maintained substantially perpendicular to the longitudinal frame axis 102 and position the first and second external ends 84*a*, 84*b* of the first and second shafts 81*b*, 82*b* a substantially equal distance from the first and second cylinders 81*a*, 82*a*, respectively.

The sling manufacturing apparatus 10 of the preferred embodiment also includes a pressure gauge 118 mounted to the hydraulic tubes to indicate the pressure in the first and second cylinders 81*a*, 82*a*. The pressure gauge 118 assists in determining the tension applied to the sling 15 and also provides an indication to the operator if the pressure exceeds a predetermined maximum pressure such that the operator can relieve pressure in the cylinders 81*a*, 82*a*.

The preferred needle valve 114 may be utilized by the operator to provide a relatively slow pressure release from the cylinders 81*a*, 82*a* to fine-tune the pressure in the cylinders 81*a*, 82*a*. In addition, the relief valve 116 is preferably automatically opened when pressure in the hydraulic tubes and sandwich 110 reaches and exceeds a maximum set pressure to prevent damage to the sling manufacturing apparatus 10.

Referring to FIGS. 4-8, the sling manufacturing apparatus 10 of the preferred embodiment includes a scale pointer 120 mounted to the second connection block 83*b* and a scale 122 mounted to the tailstock 40. The scale pointer 120 is preferably mounted to the second external end 84*b* of the second shaft 82*b*, which is connected to the second connection block 83*b*. The scale pointer 120 moves relative to the scale 122 when the second shaft 82*b* moves relative to the tailstock 40. The scale pointer 120 and the scale 122 provide an indication to the operator of the position of the idler roller 45 relative to the tailstock 40. The preferred scale pointer 120 and the scale 122 provide an indication to the operator of first and second distances D1, D2 of the idler roller 45 relative to the tailstock 40, as will be described in greater detail below. The preferred scale pointer 120 and the scale 122 specifically provide an indication of the full range of travel of the idler roller 45 relative to the tailstock 40 between a zero position Z and a maximum spaced position M. In the zero position Z, a second bump stop 124*b* connected to the second external end 84*b* of the second shaft 82*b* is in contact with or in its closest position to an external front surface of the second cylinder 82*a*. In the maximum spaced position M, the second bump stop 124*b* is spaced at its maximum distance from the second cylinder 82*a*, the piston in the second cylinder 82*a* is positioned at its furthest forward position in the second cylinder 82*a* and the idler roller 45 is positioned at its furthest working position relative to the tailstock 40. The first shaft 82*a* also preferably includes a first bump stop 124*a* that functions and is positioned similarly in comparison to the second bump stop 124*b*. The first and second bump stops 124*a*, 124*b* preferably limit the first and second shafts 81*b*, 82*b* from moving beyond the zero position toward the tailstock 40. The sling manufacturing apparatus 10 is not limited to inclusion of the scale 122, the scale pointer 120 and the first and second bump stops 124*a*, 124*b* and may operate without these components. In addition, the sling manufacturing apparatus 10 may employ alternative mechanisms to provide an indication to the operator of the position of the idler roller 45 relative to the tailstock 40, such as linear actuators, optical sensors, position sensors or other distance measuring devices or techniques that provide an indication to the operator of the position of the idler roller 45 relative to the tailstock 40 and the idler roller 45 relative to the drive roller 38.

Referring to FIGS. 1-5, in the preferred embodiment, the operator keeps track of the length of core 15*b* utilized to form the sling 15, preferably in feet of yarns or strands 25, as indicated on the encoder display 35, and stops the sling manufacturing apparatus 10 using the on/off switch 39 when the requisite length of yarn to form the load-bearing core 15*b* is drawn from the spools 99. The actual length of yarn pulled from the spools 99 and used to form the load-bearing core 15 is not limited to being precise, as long as the minimum length that was calculated at the beginning of the process for the particular sling 15 is used. A few extra feet of core 15*b* may strengthen the load-bearing cores 15*b*, but a precise length of core 15*b* is desired for repeatability and consistency in performance of the sling 15.

In the preferred embodiment, an electronic decoder control circuit may be employed to automatically turn off the sling manufacturing apparatus 10 when a predetermined minimum length of yarn or strands 25 is pulled from the spools 99. The encoder wheel 29 is preferably used to determine the length of yarn pulled from the spools 99 during the manufacturing of the load-bearing core 15*b*. The counter circuit can be integrated into the control circuitry via the electronic decoder control circuit for automatically turning off the power to the electric motor 32 when a predetermined length of yarn and core 15*b* is pulled from the spools 99. The operator preferably programs the pre-determined length of yarn to be used to manufacture the desired load-bearing cores 15*b* into the control circuitry at the beginning of the manufacturing process. After the operator turns on the sling manufacturing apparatus 10, the motor 32 preferably continues to run until the pre-determined length of yarn programmed into the control circuitry is reached, as determined by the encoder wheel 29 and signaled to the control circuitry. In this manner, the control circuitry preferably, automatically turns the sling manufacturing apparatus 10 off, thereby stopping the motor 32, the worm gear reducer 33 and the drive roller 38. Automating this step in the manufacturing process frees the operator to monitor other steps of the process, such as the integrity, twist, tension and other features of the core 15*b*, the positioning of the tailstock 40, the positioning and integrity of the cover 15*a* and other related features of the sling 15 and the sling manufacturing apparatus 10.

The positioning of the tailstock 40 relative to the drive roller 38 may also be automated via the control assembly 30 by automating the position and locking of the tailstock 40 relative to the frame 100. For example, the control assembly 30 may be configured to drive a motor (not shown) on the tailstock 40 that drives a mechanism (not shown) to move the tailstock 40 along the rails 41, 42. The operator would be able to set the positioning of the tailstock 40 on the frame 100 from the control assembly 30 to potentially improve repeatability of the slings 15 and limit significant manual manipulation of the tailstock 40. The control assembly 30 may also be configured to control positioning of the clamps 44*a*, 44*b* to and between the released and locked positions to permit movement of the tailstock 40 relative to the frame 100 in the released position and lock the tailstock 40 relative to the frame 100 in the locked position.

During the manufacturing process, the cover 15*a* of the sling 15 is placed around the idler roller 45 with the core 15*b* extending into the cover 15*a* and around the idler roller 45. A leader yarn (not shown) is preferably threaded through the cover 15*a* to lead the core 15*b* through a complete loop within the cover 15*a*. In a sling 15 having two load-bearing cores 15*b* or a twin-pass sling 15, the cover 15*a* preferably has two channels in parallel relationship. In the twin pass-type or multi-path sling 15, the first and second leader yarns, or potentially additional leader yarns, are threaded through the channels, respectively, to draw the cores 15*b* through the covers 15*a* and around the drive and the idler rollers 38, 45. Similarly, for slings 15 having more than two load-bearing cores 15*b*, a leader yarn is threaded through each of the channels of the cover 15*a* to draw the cores 15*b* through the cover 15*a* and around the drive and idler rollers 38, 45.

In operation of the sling manufacturing apparatus 10, the cover 15*a* of the sling 15 is preferably cut to allow access to the interior and the associated channels of the cover 15*a*. An exposed leader yarn has its ends tied together to form an endless loop. The leader yarn and cover 15*a* are then placed around the drive roller 38. The idler roller 45 is moved away from the drive roller 38 by moving the tailstock 40 or moved to an appropriate position spaced from the drive roller 38 for the particular sling 15 that is being manufactured. The leader yarn and cover 15*a* are then placed around the idler roller 45, thereby placing tension on the leader yarn. The number of yarns (e.g., eight) that were determined to be needed to form each load-bearing core 14*a* is then tied to each leader yarn.

When the sling manufacturing apparatus 10 is turned on, the leader yarns, being in frictional contact with the drive roller 38, are driven to rotate within their respective cover channels in the cover 15*a*. As the leader yarns rotate, they pull a plurality of yarns or strands 25 off of the spools 99. As the yarns or strands 25 are pulled from their spools 99 and through the comb 92, they are eventually drawn through their respective channels in the cover 15*a* in a circular path of travel. The plurality of individual yarns 25 preferably begin to twist in a regular manner as they are drawn within the channel of the cover 15*a*, thereby forming the endless-loop load-bearing cores 15*b*. The threads are not limited to twisting as they move into the cover 15*a* and may travel in a substantially linear manner without twisting the yarns or core 15*b*.

The covers 15*a* of the slings 15 are preferably manufactured in an independent step than the manufacture of the sling 15 on the sling manufacturing apparatus 10. In this manner, hundreds or thousands of covers 15*a* can be manufactured at a time. Moreover, the covers 15*a* can be manufactured off-site using conventional manufacturing techniques. The covers 15*a* are supplied to the sling manufacturing apparatus 10 to manufacture the load-bearing core 15*b* and for final assembly of the sling 15. The covers 15*a* are preferably manufactured with a leader line in each channel. For example, the cover 15*a* may be manufactured having two channels with two leader lines placed in the cover 15*a* with on leader line in one channel and the other lead line in the other channel.

In the preferred operation of manufacturing or producing the sling 15, the size of the sling 15 to be constructed (including diameter of load-bearing core 15*b*, which depends on the weight to be lifted, the materials, the overall length of the sling 15 and other factures) and the type of sling 15 to be made is initially decided. Based on the size (in particular the length) of the sling 15, the tailstock 40 and, particularly, the tailstock 40 and idler roller 45 are moved along the rails 41, 42 to the proper position and secured by moving the first and second clamps 44*a*, 44*b* to the locked positions by manipulating the clamp linkage 46 with the linkage wheel 47. In the locked position, the stopper surfaces 48*a*, 48*b* engage the rails 41, 42, respectively, to lock the tailstock 40 relative to the rails 41, 42 by clamping the rails 41, 42 between the stopper surfaces 48*a*, 48*b* and the first, second, third and fourth sliding blocks 70*a*, 70*b*, 70*c*, 70*d*. The sling manufacturing apparatus 10 is not limited to the described locking arrangement and may be otherwise locked to the rails 41, 42 and the frame 100.

The cover 15*a* is also selected and determined based on customer specifications and requirements. In the preferred embodiment, the inner-side of the cover 15*a* is constructed of a contrasting color when compared to the outer-side of the cover 15*a* to expedite inspection of the sling 15, particularly to indicate whether the cover 15*a* is breached or broken, thereby exposing the contrasting color of the inner side of the cover 15*a*, which is preferably a bright and easily identifiable color.

Following selection of the cover 15*a*, the cover 15*a* is preferably completely cut in a lateral direction and a cut end of the cover 15*a* is attached to a cross-bar 83 of the frame 100 proximate the drive roller 38. The cut end may be attached to the cross-bar 83 by a clamp, vise grips, pliers, fasteners, hook and loop material, spikes, adhesive bonding or nearly any mechanism that is able to secure the cut end of the cover 15*a* to the frame 100 proximate the drive roller 38 with the mouth of the cut end oriented to receive the core 15*b*. The operator preferably then pulls the cover 15*a* towards the tailstock 40 and loops the cover material around the idler roller 45, with the opposite cut end of the cover 15*a* positioned proximate the underside of the drive roller 38.

Following engagement of the cover 15*a* to the sling manufacturing apparatus 10, the appropriate number of yarns from the spools 99 is tied to the leader yarn or yarns in the cover 15*a*. Any excess leader yarn is cut off after tying it to the yarns of the core 15*b*. The yarns 25 for the core 15*b* are preferably inserted into this original loop and secured in place. The yarns for the core 15*b* may be taped, tied, clamped, adhesively bonded or otherwise secured to the leader yarn(s) such that the yarn(s) for the core 15*b* move with the leader yarn(s) when driven by the drive roller 38.

Once the yarn(s) 25 for the core 15*b* are tied to the leader yarn(s), the operator actuates the on/off switch 39 to start the electric motor 32, thereby turning the drive roller 38 through the gearbox 33. The sling manufacturing apparatus 10 draws the yarns 25 for the core 15*b* over and around the drive roller 38 and the idler roller 45 until the requisite number of loops or the requisite length of yarn(s) 25 for the core 15*b* is pulled from the spools 99. The minimum length of yarn(s) 25 for the core(s) 15*b* that was calculated at the beginning of the manufacturing process is preferably pulled from the spools 99 for the size and load-bearing capacity of the sling 15. The number of loops of yarns 25 of the load-bearing core 15*b* that are formed depends on the distance between the idler roller 45 and the drive roller 38 and the amount of time that the drive roller 38 is operated, along with additional factors. The motor 32 is preferably pulsed on and off until the original loops and tails are positioned at the drive roller 38 and are accessible to the operator, but this step is not limiting and the operator may otherwise position the loops and tails for manipulation. Since the cover 15*a* preferably does not rotate or only moves a limited amount during the manufacturing process, at least relative to the movement of the core 15*b*, the opening of the cover 15*a* remains proximate to the driver roller 38 during operation.

When setting-up the sling manufacturing apparatus 10, the yarns or strands 25 that form the core 15*b* are fed through respective openings 23 in the yarn feeder table 22 and through the respective spring-tensioning devices 27. The spring-tensioning devices 27 are adjusted to ensure that there is sufficient tension as the drive roller 38 pulls the yarn 25 for the core 15*b* from its respective spool 99. In the preferred embodiment, the yarn 25 for the core 15*b* from the spool 99 furthest from the drive roller 38 that is being utilized is wrapped around the encoder wheel 98. The leading portion of the yarns 25 are preferably secured to the leader line(s) leaving a tail by taping or otherwise securing the yarns 25 for the core 15*b* to the leader lines. The yarns 25 are separated by the elongated projections 94 in the fiber guide 92 to separate the strands 25 entering the cover 15*a*. In order to ensure that an appropriate amount of tension is applied to the leader strings, the idler roller 45 may have to be readjusted. The leader strings must be snug against the drive roller 38 so that when the drive roller 38 rotates, the leader string is pulled through its respective channel in the cover 15*a*. For a multiple-path sling 15, each leader string requires substantially equal tension.

When the appropriate number of yarns or strands 25 is fed into the cover 15*a*, the ends of the load-bearing core 15*a* are secured together or to the other portions of the core 15*b*, preferably by tying the ends of the yarns 25 together. The sling 15 can then be removed from the drive roller 38 and idler roller 45 by moving the tailstock 40 toward the drive roller 38 or moving the idler roller 45 toward the drive roller 38 to release tension from the sling 15. The idler roller 45 may or may not rotate during operation of the sling manufacturing apparatus 10, depending on the sling 15 being produced, the cover 15*a*, the core 15*b* and additional factors.

Upon removal from the sling manufacturing apparatus 10, the cover 15*a* is preferably joined at the mouths or open ends to completely cover the core 15*b*. The ends of the cover 15*a* are preferably sewn together, but are not so limited and may be adhesively bonded, fastened, clamped or otherwise secured together to cover the core 15*b* and substantially protect the core 15*b* from the environment.

In operation, to lock the tailstock 40 relative to the frame 100 once the tailstock 40 is positioned in the desired predetermined position on the frame 100, the linkage wheel 47 is rotated, preferably in a clockwise direction, by the operator. Rotation of the linkage wheel 47 actuates the clamp linkage 46. Specifically, the preferred clockwise rotation of the linkage wheel 47 pulls a pair of levers 130 of the clamp linkage 46 toward the linkage wheel 47, thereby rotating a hexagonal shaft 132 which rotates a pair of cams 134 at the ends of the hexagonal shaft 132. The rotation of the pair of cams 134 in this locking direction pushes down on the first and second clamps 44*a*, 44*b* so that they contact the tops of the first and second rails 41, 42. The downward movement of the clamps 44*a*, 44*b* into the first and second rails 41, 42 lifts at least the rear of the tailstock 40 so that the first, second, third and fourth sliding blocks 70*a*, 70*b*, 70*c*, 70*d* mounted to the first and second legs 40*a*, 40*b* contact the underside of the top flange of the rails 41, 42. The engagement between the clamps 44*a*, 44*b*, the rails 41, 42 and the sliding blocks 70*a*, 70*b*, 70*c*, 70*d* preferably locks the tailstock 40 in place relative to the frame 100. To release and relocate the tailstock 40, the linkage wheel 47 is turned, preferably in a counter-clockwise direction, to lift the clamps 44*a*, 44*b* off of and away from the rails 41, 42 to free the tailstock 40 for movement along the rails 41, 42. The sling manufacturing apparatus 10 is not limited to the specifically described components to lock the tailstock 40 relative to the frame 100 and the movement of the clamp linkage 46 and the linkage wheel 47. For example, the tailstock 40 may include a pin or pins (not shown) that engage holes (not shown) in the rails 41, 42 to lock the tailstock 40 relative to the frame 100 or other alternative mechanisms to secure the tailstock 40 relative to the frame 100, as long as the alternative locking mechanisms are able to secure the tailstock 40 relative to the frame 100 and withstand the normal operating conditions of the sling manufacturing apparatus 10.

Referring to FIGS. 1-8, to adjust the position of the idler roller 45 relative to the tailstock 40, the pump handle 85*a* is actuated to pressurize the pump 85. To move the idler roller 45 toward the drive roller 38, the directional control valve 112 is actuated to the "OUT" position or in the "OUT" direction to move the first and second shafts 81*b*, 82*b*, the first and second connection blocks 83*a*, 83*b* and the idler roller 45 toward the drive roller 38. The idler roller 45 may be moved in the out direction to the maximum spaced position M, which may permit loading of the cover 15*a* onto the idler roller 45 and the drive roller 38 or removal of the sling 15 from the idler and drive rollers 45, 38 by releasing tension from the sling 15 and/or cover 15*a*. Alternatively, to pull the idler roller 45 toward the tailstock 40 and away from the drive roller 38, the directional control valve 112 is positioned in or moved to the "IN" position. Moving the directional control valve 112 to the "IN" position causes the idler actuator 80 to pull the idler roller 45, the first and second blocks 83*a*, 83*b* and the first and second shafts 81*b*, 82*b* toward the tailstock 40 and away from the drive roller 38. The shafts 81*b*, 82*b* may move toward the tailstock 40 to the zero position, where the first and second bump stops 124*a*, 124*b* are in contact with or are located at their closest position relative to the first and second cylinders 81*a*, 82. While slings 15 are being fabricated, the directional control valve 112 is preferably positioned in the "IN" position to maintain system pressure and limit movement of the tailstock 40. The position of the idler roller 45 may also be adjusted during operation of the sling manufacturing apparatus 10 to maintain consistent pressure on the sling 15 utilizing the idler actuator 80 and the idler actuator 80 may be controlled by the control assembly 30 to maintain a predetermined tension of the sling 15 during manufacture.

To relieve pressure on the sling 15, the operator preferably manipulates the sandwich 110 to move the idler roller 45 away from the tailstock 40. In the preferred embodiment, pressure may be relieved in at least three (3) ways through the sandwich 110. Pressure may be relieved by: (1) moving the directional control valve 112 from the "IN" position toward the center position; (2) turning the needle valve 114, preferably counter-clockwise, for a relatively slower, more controlled release of pressure or (3) reaching the set maximum pressure of the relief valve 116, which will relieve pressure when the fluid or gas reaches the predetermined set maximum pressure. The operator preferably monitors the pressure in the system by observing the pressure gauge 118 and relieves pressure prior to the predetermined maximum set pressure using the directional control valve 112 or the needle valve 114 before the pressure reaches the predetermined maximum set pressure of the relief valve 116 to avoid unexpected or unwanted pressure relief. The sling manufacturing apparatus 10 is not limited to the described pressure control and relief mechanisms and may be designed and configured in numerous additional manners to release pressure and permit movement of the idler roller 45 relative to the tailstock 40 toward the maximum spaced position M.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the present disclosure.

We claim:

1. A sling manufacturing apparatus for constructing a synthetic sling having a cover and a core with the core constructed of synthetic yarns, the apparatus comprising:

a frame defining a longitudinal frame axis;

a yarn feeder assembly associated with the frame;

a drive roller connected to the frame, the drive roller being drivable to draw yarn from the yarn feeder assembly;

a tailstock movably mounted to the frame, the tailstock movable relative to the frame parallel to the longitudinal frame axis;

an idler roller movably mounted to the tailstock, the idler roller movable relative to the tailstock parallel to the longitudinal frame axis; and an idler actuator comprised of a hydraulic actuator having a first cylinder, a first shaft, a second cylinder and a second shaft, the first shaft connected to a first end of the idler roller and the second shaft connected to a second end of the idler roller, the idler actuator secured to the tailstock and the idler roller, the idler actuator configured to move the idler roller from a loading position spaced at a first distance from the tailstock to a tensioned position spaced at a second distance from the tailstock, the first distance being greater than the second distance.

2. The apparatus of claim 1, wherein the hydraulic actuator includes a pump.

3. The apparatus of claim 2, wherein the pump is a hand pump.

4. A sling manufacturing apparatus for constructing a synthetic sling having a cover and a core with the core constructed of synthetic yarns, the apparatus comprising:

a frame defining a longitudinal frame axis;

a yarn feeder assembly associated with the frame;

a drive roller connected to the frame, the drive roller being drivable to draw yarn from the yarn feeder assembly;

a tailstock movably mounted to the frame, the tailstock movable relative to the frame parallel to the longitudinal frame axis;

an idler roller movably mounted to the tailstock, the idler roller movable relative to the tailstock parallel to the longitudinal frame axis; and an idler actuator comprised of a hydraulic actuator having a pump, a sandwich, a first cylinder and a first shaft, the idler actuator secured to the tailstock and the idler roller, the idler actuator configured to move the idler roller from a loading position spaced at a first distance from the tailstock to a tensioned position spaced at a second distance from the tailstock, the first distance being greater than the second distance.

5. The apparatus of claim 4, wherein the sandwich includes a check valve, a directional control valve and a relief valve, the sandwich being in fluid communication with the pump and the first cylinder, the sandwich positioned between the first cylinder and the pump.

6. The apparatus of claim 5, wherein the hydraulic actuator further includes a second cylinder and a second shaft, the sandwich being positioned between the second cylinder and the pump.

7. The apparatus of claim 4, further comprising:

a pressure gauge mounted between the sandwich and the first cylinder.

8. A sling manufacturing apparatus for constructing a synthetic sling having a cover and a core with the core constructed of synthetic yarns, the apparatus comprising:

a frame defining a longitudinal frame axis;

a yarn feeder assembly associated with the frame;

a drive roller connected to the frame, the drive roller being drivable to draw yarn from the yarn feeder assembly;

a tailstock movably mounted to the frame, the tailstock movable relative to the frame parallel to the longitudinal frame axis;

an idler roller movably mounted to the tailstock, the idler roller movable relative to the tailstock parallel to the longitudinal frame axis;

an idler actuator comprised of a hydraulic actuator, the idler actuator secured to the tailstock and the idler roller, the idler actuator configured to move the idler roller from a loading position spaced at a first distance from the tailstock to a tensioned position spaced at a second distance from the tailstock, the first distance being greater than the second distance;

a scale pointer, the idler actuator includes a second shaft connected to the idler roller, the second shaft including a second external end secured to the idler roller in a mounted configuration, the scale pointer secured to the second external end; and a scale mounted to the tailstock, the pointer positioned relative to the scale and configured to optically represent a position of the idler roller relative to the tailstock between a zero position and a maximum spaced position.

9. The apparatus of claim 1, further comprising:

a clamp connected to the tailstock, the clamp movable between a released position and a locked position, the clamp engaging the frame in the locked position to resist movement of the tailstock relative to the frame.

10. The apparatus of claim 9, wherein the frame includes a first rail and a second rail, the tailstock includes a first sliding block slidable along the first rail and a second sliding block slidable along the second rail, the clamp including a first clamp and a second clamp, the first clamp engaging the first rail and the second clamp engaging the second rail in the locked position.

11. A sling manufacturing apparatus for constructing a synthetic sling having a cover and a core with the core constructed of synthetic yarns, the apparatus comprising:

a frame having a first rail and a second rail, the frame defining a longitudinal frame axis;

a yarn feeder assembly associated with the frame;

a drive roller connected to the frame, the drive roller being drivable to draw yarn from the yarn feeder assembly;

a tailstock having a first sliding block slidable along the first rail and a second sliding block slidable along the second rail, the tailstock movably mounted to the frame, the tailstock movable relative to the frame parallel to the longitudinal frame axis;

an idler roller movably mounted to the tailstock, the idler roller movable relative to the tailstock parallel to the longitudinal frame axis;

an idler actuator secured to the tailstock and the idler roller, the idler actuator configured to move the idler roller from a loading position spaced at a first distance from the tailstock to a tensioned position spaced at a second distance from the tail stock, the first distance being greater than the second distance;

a first clamp and a second clamp connected to the tailstock, the clamps movable between a released position and a locked position, the first clamp engaging the first rail and the second clamp engaging the second rail in the locked position, the clamps engaging the frame in the locked position to resist movement of the tailstock relative to the frame; and a clamp wheel rotatably mounted to the tailstock, the clamp wheel associated with the first and second clamps to move the first and second clamps to and between the released position and the locked position.

12. The apparatus of claim 1, wherein the first shaft includes a bump stop, the bump stop limiting movement of the first shaft toward and into the first cylinder.

* * * * *